US011234529B1

(12) United States Patent
Edwards

(10) Patent No.: US 11,234,529 B1
(45) Date of Patent: Feb. 1, 2022

(54) BACK-SUPPORT BOARD

(71) Applicant: Roy Edwards, Harrodsburg, KY (US)

(72) Inventor: Roy Edwards, Harrodsburg, KY (US)

( * ) Notice: Subject to any disclaimer, the term of this patent is extended or adjusted under 35 U.S.C. 154(b) by 0 days.

(21) Appl. No.: 16/688,297

(22) Filed: Nov. 19, 2019

(51) Int. Cl.
*A47C 16/00* (2006.01)
*A47C 9/02* (2006.01)

(52) U.S. Cl.
CPC ..... *A47C 16/00* (2013.01); *A47C 9/027* (2013.01)

(58) Field of Classification Search
CPC ..... A47C 9/027; A47C 16/00; A47C 16/005; B25H 5/00; A47B 91/02
USPC ..... 248/188.1, 188.2, 188.5, 188.8, 188.9
See application file for complete search history.

(56) References Cited

U.S. PATENT DOCUMENTS 2,595,784 A * 5/1952 Griffin ..... B25H 5/00 280/32.6
4,991,325 A * 2/1991 Teduschi ..... D06F 81/04 108/116
5,375,905 A * 12/1994 Flitter ..... A01K 97/22 297/15
5,895,062 A * 4/1999 Miles ..... B25H 5/00 280/32.6
6,095,532 A * 8/2000 Martin ..... B25H 5/00 280/30
8,505,138 B1 * 8/2013 Minichiello ..... A47C 16/00 5/632
9,370,617 B2 * 6/2016 Chepurny ..... A61G 12/008
2005/0140102 A1 * 6/2005 Trello ..... B25H 5/00 280/32.6
2005/0273929 A1 * 12/2005 Hennings ..... A47C 19/22 5/201
2006/0200909 A1 * 9/2006 Beck ..... A47C 9/027 5/652
2007/0176378 A1 * 8/2007 Bangs ..... B25H 5/00 280/32.6
2015/0246441 A1 * 9/2015 Huang ..... B25H 3/06 206/557

FOREIGN PATENT DOCUMENTS

DE 202017101206 U1 * 7/2017 ..... A47C 9/027

* cited by examiner

*Primary Examiner* — Robert G Santos
*Assistant Examiner* — Alison N Labarge
(74) *Attorney, Agent, or Firm* — Sanchelima & Associates, P.A.; Christian Sanchelima; Jesus Sanchelima

(57) ABSTRACT

A back-support board including a leg assembly, a support assembly and an assistance assembly is disclosed. The leg assembly includes adjustable legs which have insertable pegs within for reinforcing the strength of the legs to be able to support weight thereon in a stable and safe manner. The support assembly includes a base having a reinforcing layer atop and further having a top layer thereon. The top layer being of a carpet or rubber material. Once a user needs to work underneath a tight space such as under a sink, the back-support board is adjusted to a proper height and allows for the user to lay down on the back-support board to comfortably work on the necessary task with their body supported on the back-support board. The back-support board is adjustable to allow fitting under different tight spaces for completing different tasks in a more comfortable manner.

1 Claim, 3 Drawing Sheets

BACK-SUPPORT BOARD

BACKGROUND OF THE INVENTION

1. Field of the Invention

The present invention relates to a back-support board and, more particularly, to a back-support board that can be adjusted in height in order to facilitate working under spaces, especially under tight spaces.

2. Description of the Related Art

Several designs for back-support boards have been designed in the past. None of them, however, include insertable pegs combined with adjustable legs and a carpet and/or rubber surface. The back-support board of the present invention allows a user to work comfortably under tight spaces such as those under a vanity, cabinets or the like. The present invention being adjustable to be functional under different tight spaces.

Applicant believes that a related reference corresponds to U.S. Pat. No. 8,505,138 for an Adjustable Back Platform Device. Applicant believes another related reference corresponds to U.S. patent No. 2007/0176378 for a Plumber's Helper. None of these references, however, teach of insertable pegs combined with adjustable legs for reinforcing the strength of the adjustable legs to allow for being able to hold a greater amount of weight thereon. Further, none include a top layer being of a carpet or rubber material for providing comfort to a user.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a back-support board that makes working underneath tight spaces easier.

It is another object of this invention to provide a back-support board that makes working under tight spaces more comfortable.

It is still another object of the present invention to provide a back-support board that includes adjustable legs that allow for adjusting a height of the back-support board to be capable to comfortably work underneath different tight spaces.

It is another object of the present invention to provide a back-support board that includes insertable pegs for reinforcing the adjustable legs to allow for supporting a greater weight thereon.

It is yet another object of this invention to provide such a back-support board that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
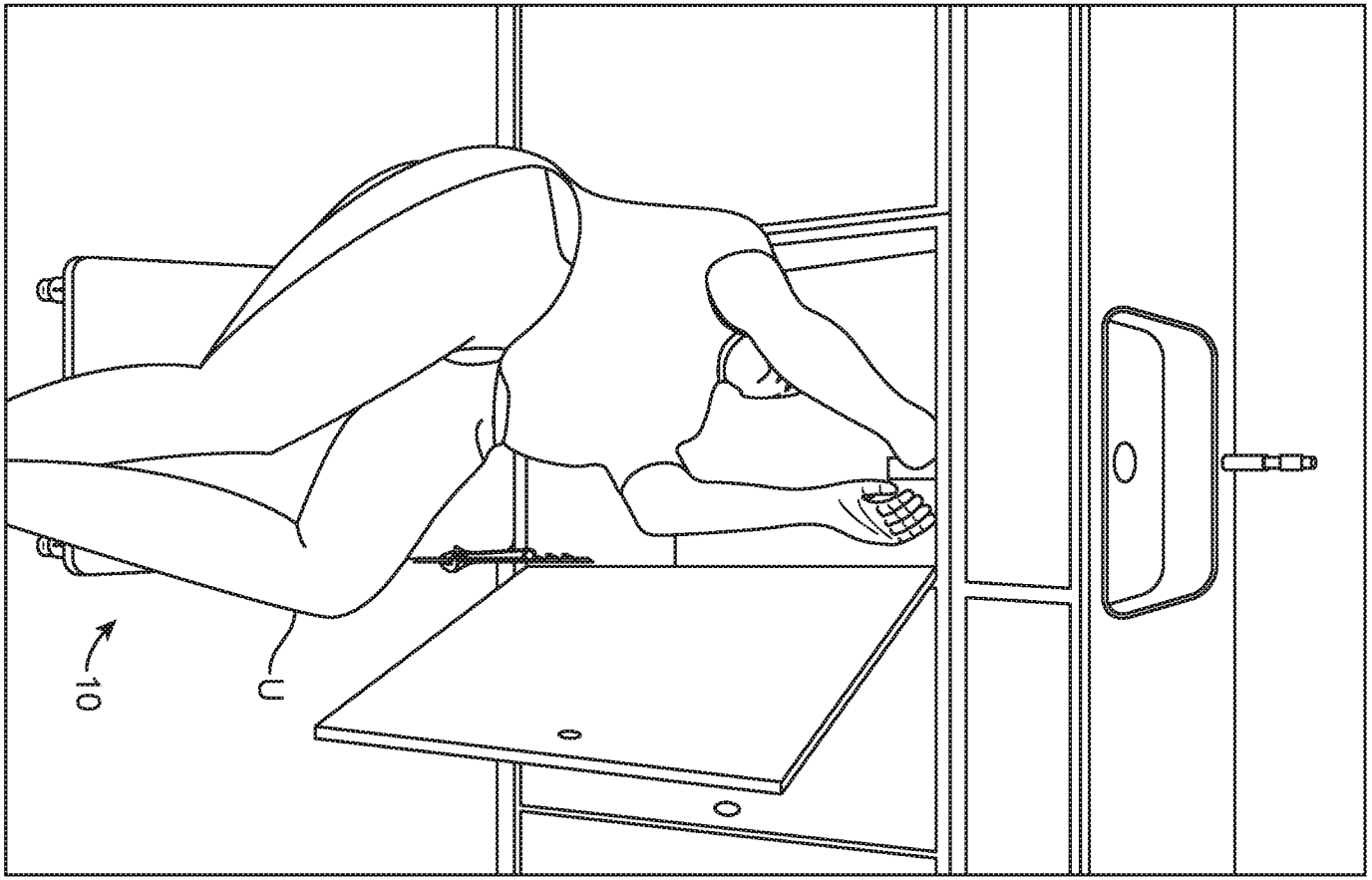
FIG. 1 represents the present invention in an operational setting with a user working underneath a tight space.

Referring now to the drawings, where the present invention is generally referred to with numeral 10, it can be observed that it, a back-support board 10, basically includes a leg assembly 20, a support assembly 40 and an assistance assembly 60.

Figure 2:
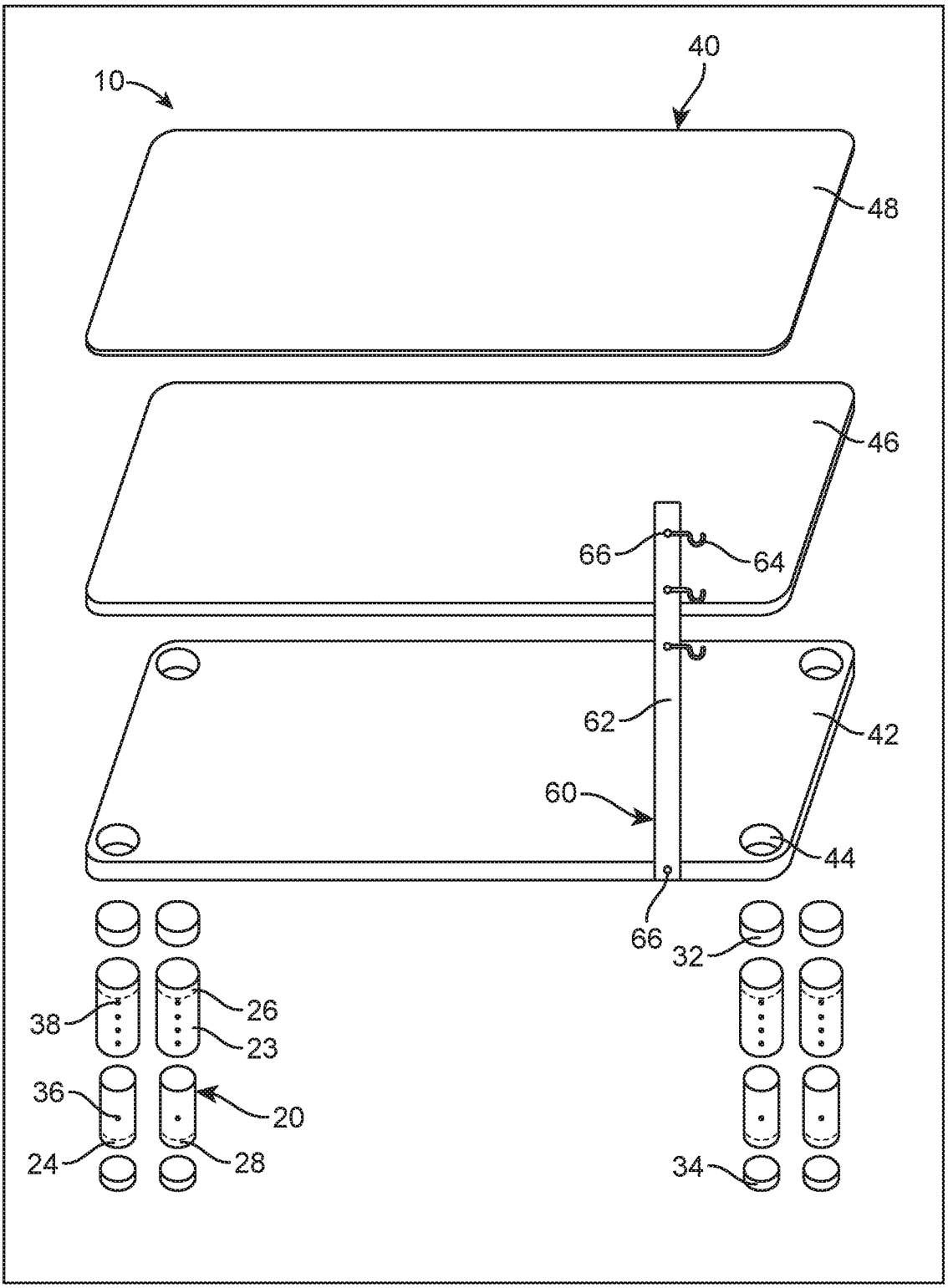
FIG. 2 shows an exploded view of the present invention.
Figure 3:
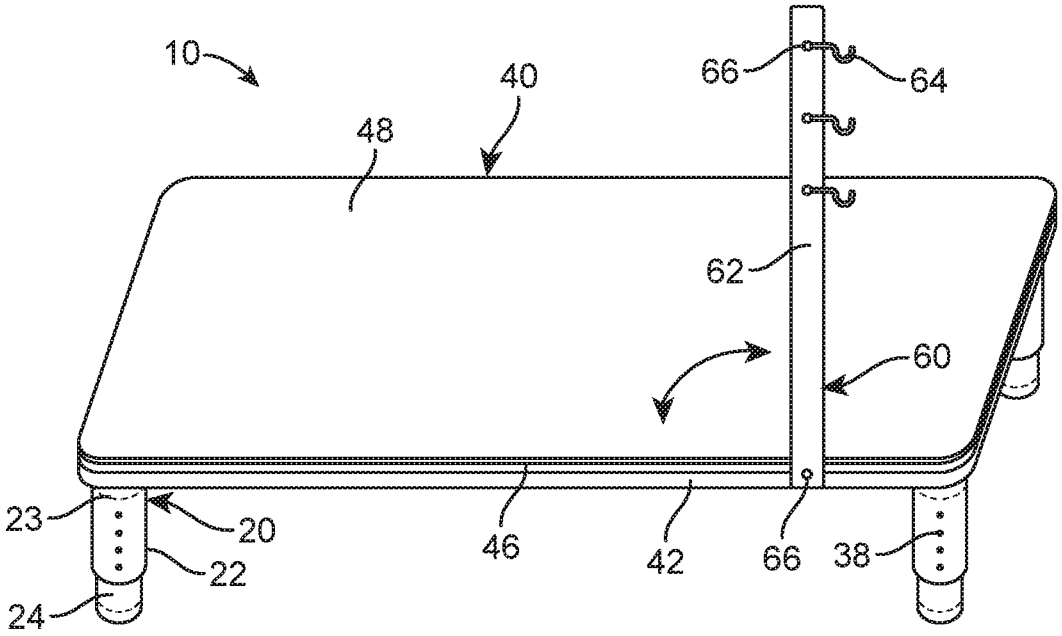
FIG. 3 illustrates an isometric view of the present invention fully assembled.

The present invention can be seen in FIGS. 1-3. It can be seen that leg assembly includes adjustable legs 22 which can be adjusted in height to allow for making the present invention taller or shorter as per the needs of a user U. User U may opt to modify the height of the present invention in order to allow for comfortable fitting underneath a required tight space depending on the job user U may be required to complete. In one embodiment, there may be four of adjustable legs 22, all being identical. Each of adjustable legs 22 may include a leg top portion 23 and a leg bottom portion 24. In one embodiment, leg top portion 23 may have dimensions greater than the dimensions of leg bottom portion 24. Preferably, adjustable legs 23 are cylindrical, but other shapes may be suitable. At a top end of each of leg top portion 23 may be a leg top opening 26 of predetermined dimensions that extends downwardly a predetermined amount into leg top portion 23. At a bottom end of each of leg bottom portion 24 may be a leg bottom opening 28 of predetermined dimensions that extends upwardly a predetermined amount into leg bottom portion 24. Preferably, leg top opening 26 and leg bottom opening 28 may be circular. However, it should be understood that other shapes may be suitable for leg top opening 26 and leg bottom opening 28. Preferably, leg top opening 26 may be of dimensions greater than the dimensions of leg bottom opening 28. Inserted into each of leg top opening 26 may be a large insertable peg 32. As such, large insertable peg 32 may be of a dimension and shape that cooperates with leg top opening 26. Inserted into each of leg bottom opening 28 may be a small insertable peg 34. As such, small insertable peg 34 may be of a dimension and shape that cooperates with leg bottom opening 28. It may be preferable for adjustable legs 22 to be substantially hollow. Hence, there is a need to reinforce and strengthen adjustable legs 22 as adjustable legs 22 are to support weight mounted on back-support board 10. Large insertable peg 32 and small insertable peg 34 aid in reinforcing and strengthening each of leg top portion 23 and leg bottom portion 24, respectively. It may be suitable for each of adjustable legs 22 to be made of materials such as wood, plastic, aluminum, steel, metal, rubber or the like as known in the art.

Adjustable legs 22 may preferably be light weight, yet durable and strong. Adjustable legs 22 may be adjusted in height to accommodate fitting under different tight spaces of different dimensions. Leg top portion 23 may have dimensions greater than those of leg bottom portion 24 in order to be able to receive leg bottom portion 24 partially therein. In order to allow for adjusting of adjustable legs 22, leg bottom portion 24 may include a push button 36 at a top end thereof. Push button 36 may be manually pressed to be recessed within leg bottom portion 24 until being released. Leg top portion 23 may include height openings 38 along a height thereof. Push button 36 may be of a dimension and shape that cooperates with the dimensions and shape of height openings 38. To adjust the height of adjustable legs 22, user U may press push button 36 and release it once a desired of height openings 38 is reached which corresponds with the desired height of each of adjustable legs 22.

Back-support board 10 may further include support assembly 40. Support assembly 40 may importantly include base 42. Base 42 may preferably be substantially rectangular and of predetermined dimensions. At each corner of base 42 may be a base leg opening 44. In one embodiment, back-support board 10 includes four of base leg opening 44. Each of base leg opening 44 may be of dimensions and shape that corresponds and cooperates with snuggly and securely receiving one of leg top portion 23 therein. It may be preferred that the top end of each of leg top portion 23 is received in each of base leg opening 44. It may be preferable that leg top portion 23 is inserted into base leg opening 44 from underneath. Leg top portion 23 having large insertable peg 32 within may be flush with base 42 and base leg opening 44 when inserted in base leg opening 44. In one embodiment, leg top portion 23 may be secured within base leg opening 44 with fasteners 66 or other fastening means as known in the art of fastening and mounting such as adhesives, screws, nails, welding, snap buttons, hook and loop straps or the like. Base 42 may preferably be made of plastic, however, it should be understood that other materials such as wood, aluminum, metal, steel, plywood, combinations thereof or the like may also be suitable for base 42. Mounted on base 42 may be a reinforcing layer 46. Reinforcing layer 46, may preferably be of a shape that cooperates with fitting flush on base 42. It may be suitable for reinforcing layer 46 to be of a same length and width as base 42. However, in one embodiment, base 42 and reinforcing layer 46 may have different heights or thickness. Reinforcing layer 46 may be entirely solid. It may be suitable for reinforcing layer 46 to be mounted and secured to base 42 with fastener 66. However, it may be suitable for reinforcing layer 46 to be mounted onto base 42 with an adhesive, screws, nails, welding, snap buttons, hook and loop straps or the like as known in the art of mounting. Preferably, reinforcing layer 46 may be made of plywood, however it may be suitable for reinforcing layer 46 to be made of aluminum, plastic, wood, steel, metal rubber, plastic, combinations thereof or the like. Mounted to reinforcing layer 46 may be a top layer 48. Top layer 48 may be adapted to provide comfort to user U being on back-support board 10. Top layer 48 may be of dimensions and shape that allow for top layer 48 to be mounted flush with reinforcing layer 46. Top layer 48 may be entirely solid. It may be suitable to secure top layer 48 to reinforcing layer 46 with fasteners 66. Reinforcing layer 46 is sandwiched between base 42 and top layer 48. Preferably, top layer 48 may be made of a carpet or rubber material. It, however, may be suitable for top layer 48 to be made of other materials such as cotton, wool, plastic, wood, leather or the like. Top layer 48 may be of a material that allows comfort to user U even after prolonged usage of the present invention.

Back-support board 10 may further include assistance assembly 60 which may be adapted to further facilitate the work of user U. In one embodiment, assistance assembly 60 may be removably mounted to base 42. Assistance assembly 60 may include a bar 62 rotatably mounted to base 42 with fastener 66. Bar 62 may include an open and a closed configuration. In the closed configuration, bar 62 may be parallel to base 42. In the open configuration, bar 62 may be substantially perpendicular to base 42. Bar 62 may be mounted to any side of base 42 along an outer perimeter thereof. Bar 62 may be manually positioned in the open or closed configuration. Extending along bar 62 at predetermined locations may be hooks 64. Hooks 64 may extend outwardly beyond the lateral edges of bar 62. In the open configuration, hooks 64 may be upwardly facing and parallel to each other. Hooks 64 may be adapted to receive and hold items thereon. Those items may be virtually any items that user U may need to complete the required job. For example, a drill, a wrench or any other necessary tools may be held by hooks 64.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a back-support board, consisting of:

a. a leg assembly including four adjustable legs, each of said four adjustable legs being cylindrical and includes a leg top portion and a leg bottom portion, said leg top portion includes a leg top opening extending downwardly a predetermined distance within said leg top portion at a top end of leg top portion, said bottom leg portion includes a leg bottom opening extending upwardly a predetermined distance within said leg bottom portion at a bottom end of bottom leg portion, said leg top opening receiving a large insertable plug to reinforce said top leg portion, said leg bottom opening receiving a small insertable plug within to reinforce said leg bottom portion, said leg top portion further includes height openings extending vertically along a length of said leg top portion, said leg bottom portion includes a push button, said leg bottom portion is received by said leg top portion, said push button is operated and pressed to be recessed within said leg bottom portion until a desired of said height openings is reach, said push button protruding through said height openings to achieve a desired height of said adjustable legs; and b. a support assembly including a rigid base having rounded corners, said rigid base including base leg openings at said rounded corners, said base leg openings receive said leg top portion within to mount said rigid base to said adjustable legs, said support assembly further including a rigid reinforcing layer and a top layer, said reinforcing layer mounted atop of said rigid base, wherein said reinforcing layer is made of plywood, said top layer may be mounted on said reinforcing layer, said support assembly capable of supporting a user thereon, wherein said support assembly is configured to have a user place their back on said support assembly, said reinforcing layer providing added stability to said back-support board, said top layer providing added comfort to said user on said back-support board; and c. an assistance assembly mounted on a perimeter side of said base along an outer perimeter with a base fastener, said assistance assembly includes a uniform bar having an open and closed configuration, said uniform bar being parallel to said base in the closed configuration, said uniform bar being perpendicular to said base in the open configuration, said uniform bar includes hooks at predetermined locations at a length of said uniform bar, wherein said hooks include a straight portion perpendicular to said uniform bar, said straight portion having a U-shaped portion extending from the distal end of the straight portion with respect to the uniform bar, said hooks secured to said uniform bar with hook fasteners, said hooks capable of receiving and holding tools thereon.

* * * * *